United States Patent [19]

Giguere

[11] Patent Number: 4,922,656

[45] Date of Patent: May 8, 1990

[54] SASH WINDOW

[75] Inventor: Jean-Paul Giguere, Co. Lotbinière, Canada

[73] Assignee: Donat Flamand Inc., Canada

[21] Appl. No.: 133,084

[22] Filed: Dec. 15, 1987

[51] Int. Cl.[5] ..... E05D 15/22

[52] U.S. Cl. ..... 49/161; 49/181

[58] Field of Search ..... 49/161, 176, 181

[56] References Cited

U.S. PATENT DOCUMENTS

| | | | |
|---|---|---|---|
| 3,963 | 3/1945 | Shirer et al. . | |
| 690,417 | 1/1902 | Golden . | |
| 988,277 | 3/1911 | Meixel . | |
| 1,019,337 | 3/1912 | McConnell . | |
| 1,110,841 | 9/1914 | Venske . | |
| 2,361,551 | 10/1944 | Levyn . | |
| 2,652,602 | 9/1953 | Etling . | |
| 2,987,783 | 6/1961 | Griffith . | |
| 3,399,490 | 9/1968 | Hettinger . | |
| 3,461,608 | 8/1969 | Johnson . | |
| 3,905,154 | 9/1975 | Anderson | 49/161 X |
| 4,028,849 | 6/1977 | Anderson | 49/181 |
| 4,068,406 | 1/1978 | Wood | 49/181 |
| 4,644,691 | 2/1987 | Wright | 49/161 |

*Primary Examiner*—James R. Brittain

*Attorney, Agent, or Firm*—Larson and Taylor

[57] ABSTRACT

The present invention relates to a sash window comprising a window frame made of wood and in which are mounted glazed sashes, at least one being slidable. On each jamb of the window frame is mounted a track with two pairs of guiding projections, each pair of projections being received in corresponding grooves provided on the sash frames. The guiding projections allow the sliding sash to move by translation in the window frame. The sliding sash may also be tilted out of the window frame by pulling the sash for disengaging the guiding projections from the corresponding guide grooves. When tilted, the sash remains attached to the window frame by a pair of runners received in the tracks on the jambs of the window frame.

6 Claims, 3 Drawing Sheets

SASH WINDOW

FIELD OF THE INVENTION

The present invention relates to windows and more particularly to improved means for slidably mounting a sash in a window frame, especially for a sash of the type tiltable with respect to the window frame.

BACKGROUND OF THE INVENTION

Sash windows are very popular in North America. Typically, such a window comprises a window frame made of wood in which are mounted glazed sashes which can slide in the frame along a generally vertical axis. The glazing element of the sashes may be simple, double or triple and sealed depending upon the desired degree of thermal insulation.

To facilitate cleaning and repair of a sash window, it has been suggested to provide the window with a device allowing to tilt the sliding panel inwardly of the building to ease access to the outer face of the panel. Although this idea is interesting, it is difficult to put in practice because the device allowing for the translatory motion and the rotation of the sash in the window frame is complex and in most cases, it does not guarantee a good thermal insulation.

The following U.S. Patents illustrate various attempts made by the past to design such a system:

| | |
|---|---|
| 988 277, MEIXEN | March 28, 1911 |
| 2 361 551, LEVYN | October 31, 1944 |
| 2 987 783, GRIFFITH | June 13, 1961 |
| 3 399 490, HETTINGER | September 3, 1968 |

Generally speaking, none of the windows disclosed in these patents is entirely satisfactory because they are difficult to manufacture or do not meet the required standards for air-infiltration and thermal insulation which are important factors for countries with a harsh climate during the winter.

OBJECTS AND STATEMENT OF THE INVENTION

Thus, an object of the present invention is an improved sash window of simplified construction with good thermal insulation qualities and offering high resistance to air infiltration.

Another object of the invention is a window having a slidable and a pivotable sash, with an improved guiding and supporting system for the sash allowing to reach a high thermal efficiency.

The window, according to the present invention, comprises a window frame, made preferably of wood and having generally a rectangular configuration, in which are mounted sashes, at least, one of the sashes being capable of translatory motion in the window frame. A relatively flexible track is mounted to the inner face of each jamb of the window frame to support and guide the sash during the translatory movement thereof. In a preferred embodiment of the invention, the track is provided with a pair of guiding projections, slightly spaced apart and extending from top to bottom of the jamb. The guiding projections are resiliently received into respective seats provided on the sash jamb of the sash, facing the track. Thus, the sash of the window is supported and guided when moving by translation in the window frame by two pairs of guiding projections, on each side of the sash.

To permit the sliding sash to tilt out, a runner is mounted to each sash jamb by means of a pivot. The runners are received into grooves provided on the tracks on the window frame so as to move with the sash when the sash slides in the window frame. To tilt out the sash it is sufficient to pull the latter so as to disengage the guiding projections from their respective seats on the sash jambs. To facilitate this operation, the guiding projections as well as their respective seats on the sash jambs are rounded in cross-section.

When the sliding sash has been disengaged from the tracks on the window frame, it remains attached to the window frame by means of the runners. Thus, the sliding sash may pivot about an axis generally perpendicular to direction of translatory motion of the sash.

Preferably, each runner is provided with a stop device actuated upon tilting out the sash which immobilizes the runner against sliding in the associated track on the window frame. This feature acts as a safety device preventing the sash to slide when it is tilted-out.

It is obvious to those skilled in the art that the guiding system described earlier is applicable to various types of sliding windows, be it horizontally or vertically sliding windows.

The present invention comprises in a general aspect, a window comprising:

a window frame;

at least one glazed sliding sash mounted in said window frame, said sash being movable by translation in said window frame, said sliding sash including a sash frame comprising four elongated members, namely two jambs joined at their upper ends by a sash head and joined at their lower ends by a sash sill; and a guiding and support device between each elongated member of said sash frame which is generally parallel to the direction of translatory motion of said sliding sash and said window frame, said support and guiding device comprises a first element on said window frame and a second element on the elongated member, said first and second elements being resiliently engaged together, one of said elements being a pair of generally parallel guiding projections and the other element being a pair of grooves receiving said guiding projections, said guiding projections and said grooves being generally rounded in cross-section allowing to disengage said guiding projections from said grooves upon a pull exerted on said sash in a direction generally normal to the direction of translatory motion of said sliding sash in said window frame.

DESCRIPTION OF A PREFERRED EMBODIMENT

Figure 1:
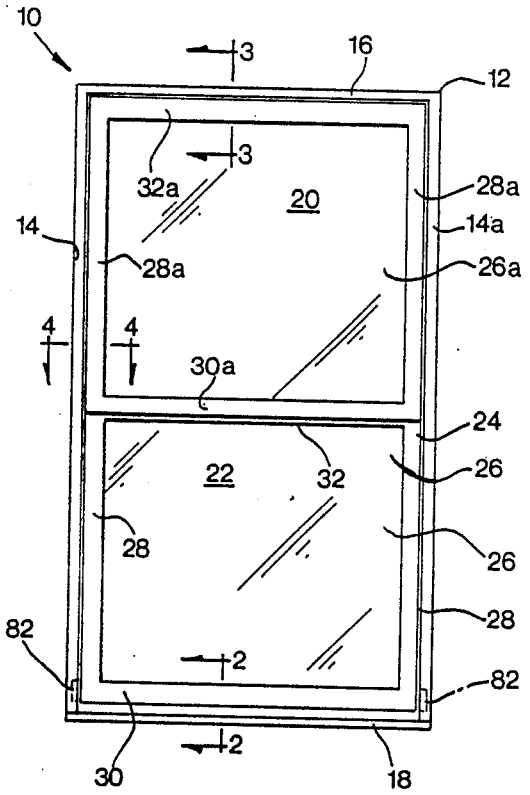
FIG. 1 is an elevational view from the outside of a window according to the invention.

Referring to the attached drawings, more particularly to FIG. 1, a sash type window according to the invention, identified generally by the reference numeral 10, comprises a window frame 12 made of wood, and having a generally rectangular configuration, comprising two jambs 14 joined at their upper ends by a head member 16 and at their lower extremities by a sill member 18.

In the window frame 12 are mounted two sashes 20 and 22, respectively, the sash 22 being movable by translation along a generally vertical axis in the window frame 12 and the sash 20 being stationary. It is evident, however, that the invention is not limited to this particular arrangement since the sash 20 may be made slidable as well without departing from the spirit of the invention.

The sliding sash 22 comprises a rectangular sash frame 24 made of wood and which supports a glazing unit 26, preferably double and sealed. However, a single or triple glazed units may be used in the sash frame 24 depending upon the desired degree of thermal insulation.

The sash frame 24 is constituted of two parallel jambs 28, a sash sill member 30 and a sash head member 32 (not shown in FIG. 1).

The structure of the stationary sash 20 is identical to the structure of the sliding sash 22. To facilitate and simplify the description, the elements of the stationary sash 20 which correspond to those of the sliding sash 22 will be identified in drawings by the same reference numerals followed by the suffix "a".

Figure 2:
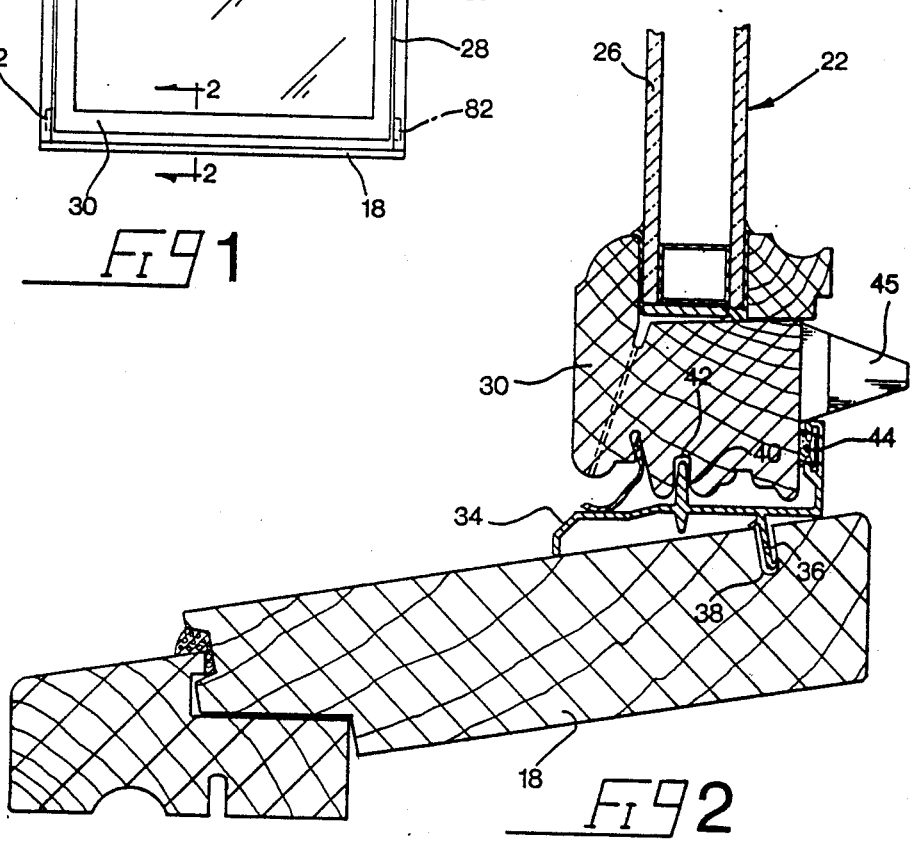
FIG. 2 is an enlarged cross-sectional view taken along lines 2—2 of FIG. 1.

When the sliding sash 22 is in the closed position, as shown in FIG. 1, the sash sill member 30 abuts on the sill member 18 of the window frame 12, as best shown in FIG. 2. An extrusion 34 of plastic material is mounted on the sill member 18 and extends from the left jamb to the right jamb of the window frame 12. The extrusion 34, whose purpose is to form a barrier against air infiltration is secured to the sill member 18 by means of a leg 36 penetrating into a deep groove 38 formed on sill member 18. Obviously, an attachment by means of screws or other types of fasteners may be envisaged, however, this arrangement is less desirable because it requires additional steps on the assembly line of the window, resulting in an increase of the manufacturing costs.

The extrusion 34 comprises on its upper face a projection 40 penetrating into a groove 42 formed on the sash sill member 30, when the latter is in contact with the extrusion 34. In that position, the sash sill member 30 is in contact with a weather strip 44 of known construction mounted on the extrusion 34.

A handle 45 is mounted on the sash member 30 to facilitate the opening and closing of the sliding sash 22.

Figure 3:
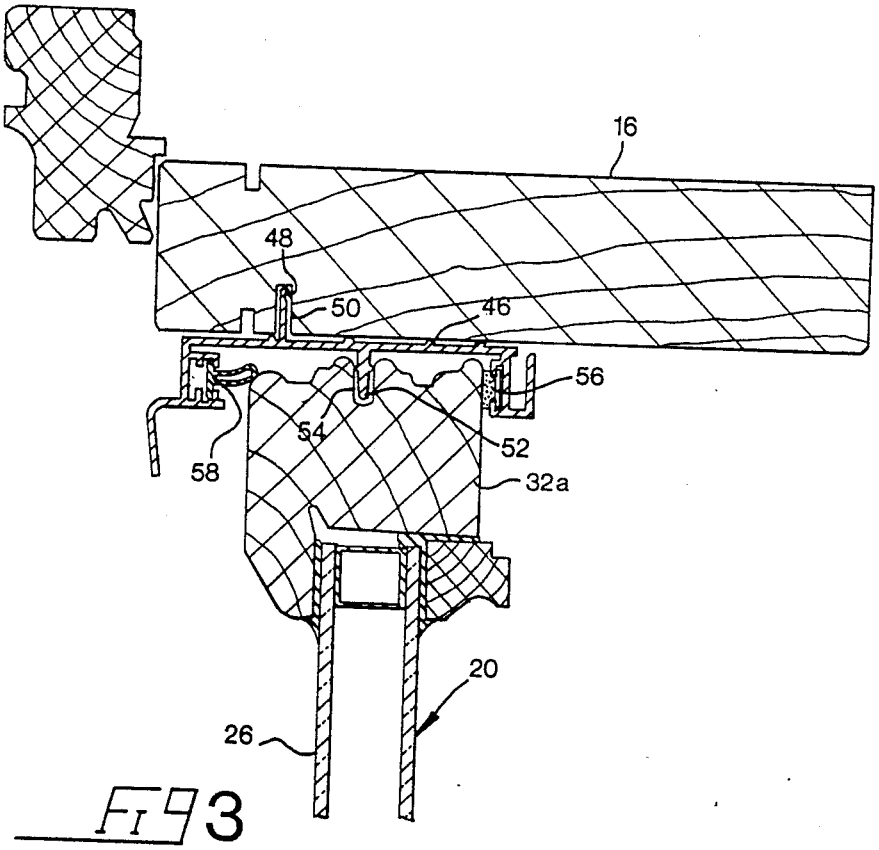
FIG. 3 is an enlarged cross-sectional view taken along lines 3—3 of FIG. 1.

Referring now to FIG. 3, an extrusion 46, generally similar to the extrusion 34 is provided to act as a barrier against air infiltration between the head member 16 of the window frame 12 and the sash head member **32*a* of the stationary sash 20. The extrusion 46 is mounted on the head member 16 by a leg 48 penetrating into a groove 50 formed on the head member 16 and comprises a projection 52 received into a groove 54 on the sash head member 32*a*. Also, a weather strip 56 contacts the sash head member 32*a* to reduce air infiltration. If desired, an additonal weather strip 58 opposite weather strip 56 may be used. The weather strips 56 and 58** are of known construction and they will not be described in detail.

Figure 4:
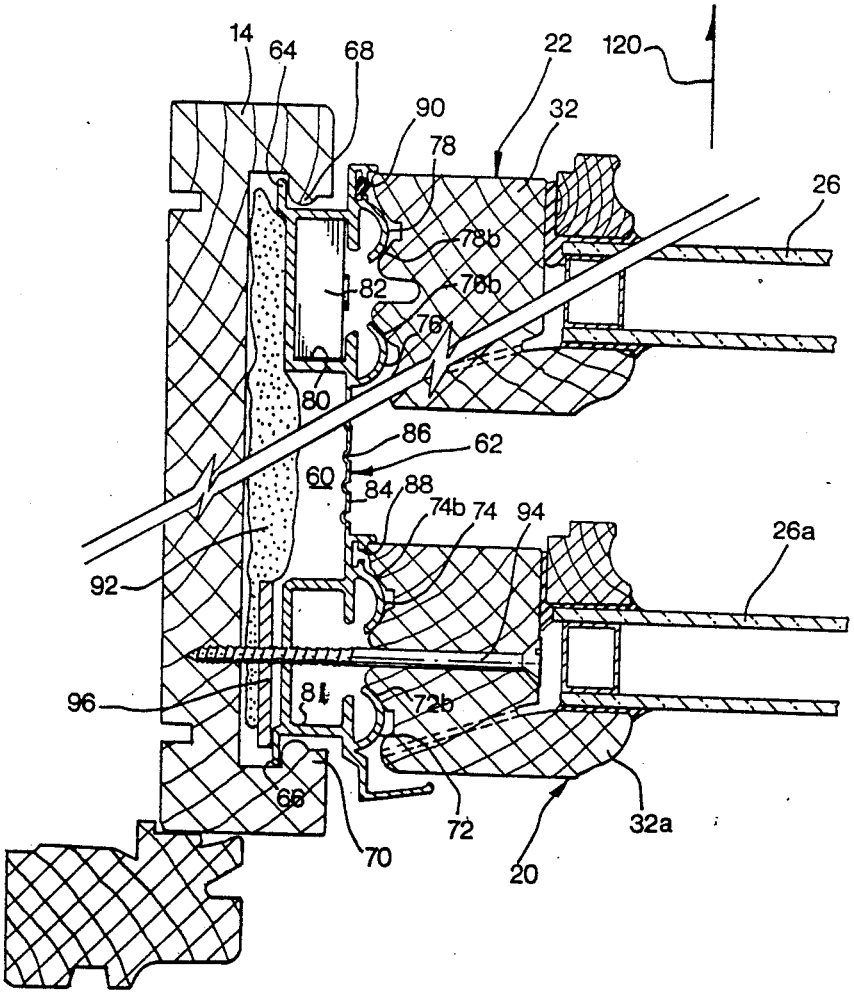
FIG. 4 is an enlarged cross-sectional view taken along lines 4—4 of the window shown in FIG. 1, when the sliding sash is in the opened position.

Referring now to FIG. 4, each jamb 14 of the window frame 12 is provided with a wide and deep groove 60 extending from the sill member 18 up to the head member 16 of the window frame 12 in which is mounted a track 62 in the form of an extrusion of plastic material which is a poor heat conductor. The track 62 is retained in the groove 60 against an accidental dislodgement by a pair of laterally extending projections 64 and 66 which abut against stops 68 and 67 edging the groove 60.

The track 62 comprises two pairs of guiding projections 72, 74 and 76, 78, engaging the sashes 20 and 22, respectively, of the window 10. Each guiding projection is generally semi-circular in cross-section and it has only one edge attached to the track 62 which allows the guiding projection to flex slightly towards the jamb 14. Between the guiding projections 72, 74 and 76, 78 are provided deep grooves 80 and 81, respectively. The groove 80 defines a track for a runner 82 which will be described in detail hereinafter.

The pairs of guiding projections 72, 74 and 76, 78 are interconnected by a thin and elongated plate 84 which comprises shallow and parallel grooves 86 extending lengthwise on the plate 84. This arrangement gives a certain flexibility to the plate 84, thus, allowing each pair of guiding projections to flex slightly, without inducing a corresponding movement in the other pair of guiding projections.

Each guiding projection of the track 62 is resiliently received into a closely conforming groove formed on the jamb of a sash. To simplify the description, the grooves will be identified by the same reference numerals identifying the guiding projections which are received therein, followed the suffix "b". The grooves **72*b*, 74*b*, 76*b* and 78*b*** extend lengthwise on the uprights of the sash frames on which they are formed and they closely conform to the guiding projections.

To ensure a good thermal insulation, weather strips 88 and 90 are mounted to the track 62 and are in contact with the jambs **28*a* and 28, respectively. Furthermore, the space between the track 62 and the bottom wall of the groove 60 is filled with insulating urethane foam 92**.

As mentioned earlier, the sash 20 is stationary and cannot be moved. The sash 20 is secured by means of wood screws 94 (only one being shown in FIG. 4) which extends through the jamb **28*a* and is engaged in the jamb 14 of the window frame 12. To ensure the stability of the stationary sash 20 against lateral movements, a shim 96 is mounted between the bottom wall of the groove 60 and the layer of urethane foam 92**.

The description of the various elements of the window allowing to support the sashes 20 and 22 in the window frame 12 has been given with reference to FIG. 4 which illustrates only one with the jambs of the window frame 12. It is to be understood that the structure of the other jamb of the window frame 12 is identical.

Figure 5:
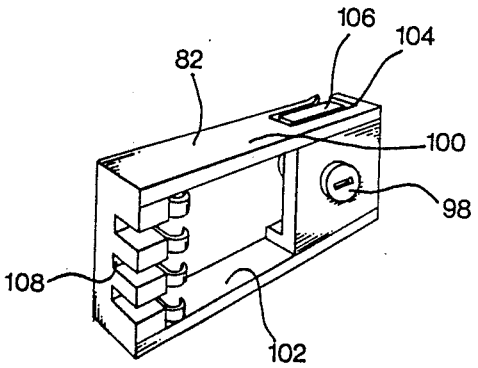
FIG. 5 is an enlarged perspective view of an element of the window according to the invention.

FIG. 5 is a perspective view of runner 82 mounted in the track 80 provided between the guiding projections 76 and 78. A runner 82 is mounted to the each jamb 28 of the movable sash 22 (shown in dotted lines in FIG. 1) by means of a pivot having an extremity extending from a housing of generally rectangular configuration provided with side-walls 100 and 102, each side-wall comprising a rectangular opening 104 in which is received a stop element 106 extendable when the pivot 98 is rotated. This is achieved by means of a cam (not shown)

mounted to the extremity of the pivot 98 which is opposite to the one connected to the movable panel 22.

Also, springs may be provided to retract the stop elements 106 when the pivot 98 is turned back to its original position, in other words when the sash 22 is pushed back to be coplanar with the window frame 12.

The runner 82 is also provided with a holder 108 for receiving and end of a spiraled counterbalancing device well known in the art. The counterbalancing device has an extremity mounted to the head member 16 of the window frame 12 and another extremity mounted to the runner 82. The counterbalancing device is mounted in the track 82 and act as a spring, storing energy when the sash 22 is in the closed position and restoring the energy when the sash is opened, in order to reduce the effort necessary to open the sash 22.

To limit the rotational movement of the sash 22 when it is tilted out, to approximately 90° degrees, it is possible to provide the window with a small chain or a telescopic arm of a type well known in the art having one end attached to the window frame 12 and an opposite end attached to the sash frame 24. The length of the telescopic arm is such that it reaches maximum extention when the sash 22 is generally perpendicular to the window frame 12 and does not allow for any further downward movement of the sash 22.

The operation of the window 10, according to the invention, is as follows.

The sliding sash 22 is free to move by translation in the window frame 12 by sliding on the guiding projections 76 and 78 engaged in the jambs 28 of the sash 22. To tilt out the sash 22, it is sufficient to pull the sash inwardly, in the direction of the arrow 120 shown in FIG. 4, to disengage the jambs 28 from the guiding projections 76 and 78. The relative flexibility of the track 62 in a lateral direction as well as the rounded configuration of the guiding projections and the grooves receiving the projections facilitate this operation. When the sash 22 begins to pivot, the cams mounted on the pivots 98 push outwardly the stop elements 106 which abut on the side walls of the grooves 80 to stop the runners 82 and prevent any movement of the sash 22 in a vertical direction.

To put back the movable sash 22, it is sufficient to push back the sash 20 so as to engage the guiding projections 76 and 78 in the corresponding grooves **76*b* and 78*b*. The rotation of the pivots 98 of both runners 82 results in retracting the stop elements 106 so that the runners 82** are free to move.

Although, the invention has been described with relation to a specific form, it should be understood that various refinements and modifications may be made without departing from the spirit of the invention. Therefore, this description should be considered only as an example of the invention and it should not be interpreted in any limiting manner. The scope of the invention is defined in the annexed claims.

I claim:

1. A window, comprising:

a window frame;

a glazed sash mounted in said window frame movement by translation therein, said sash including a sash frame comprising four elongated members, namely, two jambs joined at their upper ends by a head member and joined at their lower ends by a sill member; and a guiding and supporting device between each elongated member of said sash frame which is parallel to the direction of movement by translation of said sash in said window frame, said guiding and supporting device comprising:

(a) a pair of generally parallel grooves formed on said sash, each of said grooves being rounded in cross-section;

(b) a track on said window frame including a pair of generally parallel and elongated guiding projections, each guiding projection being rounded in cross-section, and means to connect said each guiding projection to said track and to allow said each guiding projection to flex with respect to the remaining portion of said track, said guiding projections being resiliently engaged in said grooves during the translatory motion of said sash in said window frame, said sash being completely disengagable from said guiding projections upon exerting a force on said sash in a direction normal to the direction of translatory motion thereof, wherein said window frame comprises two jambs, a head member joining said jambs at their upper ends and a sill member joining said jambs at their lower ends, and each jamb of said window frame comprises a track, including:

two pairs of guiding projections extending along a longitudinal axis of said each jamb, each pair of guiding projections engaging a sash; and an elongated flexible plate interconnecting said pairs of guiding projections, said elongated plate extending along said longitudinal axis and including a plurality of longitudinal shallow grooves enhancing the flexibility of said elongated plate, thereby allowing one pair of guiding projections to move substantially independently of the other pair of guiding projections.

2. A window as defined in claim 1, further comprising a runner mounted to said sash and slidingly received in said track, said runner extending along a pivotal axis of said sash in said window frame.

3. A window as defined in claim 2, wherein said runner further comprises stop means responsive to a pivotal movement of said sash in said window frame, whereby said stop means immobilizes said runner in said track upon disengagement of said guiding projections from said grooves.

4. A window as defined in claim 2, wherein said track defines an elongated channel between said guiding projections receiving said runner.

5. A window, comprising:

a window frame having a generally rectangular configurations including two jambs, a head member joining said jambs at their upper ends and a sill member joining said jambs at their lower ends;

two extrusions of plastic material, each being mounted to a respective jamb and extending along a longitudinal axis thereof, said each extrusion of plastic material comprising:

(a) a body;

(b) two generally parallel sash guiding and supporting members longitudinally extending with respect to said body, each said guiding and supporting member being rounded in cross-section and having a longitudinal edge connected to said body and solely constituting means for retaining said each sash guiding and supporting member to said body, thereby allowing said each sash guiding and supporting member to flex with respect to said body; and (c) an elongated channel between said sash guiding and supporting members; and a glazed sash mounted to said window frame, said glazed sash including:

(a) two pairs of grooves, each pair of grooves facing a respective extrusion of plastic material and resiliently engaging the sash guiding and supporting members thereof, whereby said sash is movable by translation in said window frame;

(b) two runners mounted to said sash, each runner slidingly engaging the elongated channel of a respective extrusion of plastic material to slide therein during a translational movement of said sash in said window frame; and (c) stop means on each runner, said stop means being responsive to a pivotal movement of said sash in said window frame, whereby a pull exerted on said sash in a direction normal to the direction of translatory motion thereof causes a disengagement of the sash guiding and supporting members from the respective grooves of said sash, and said stop means prevents movement of said each runner in the respective channel.

6. A window as defined in claim 5, wherein said each extrusion comprises two pairs of sash guiding and supporting members, each engaging a respective sash, a thin elongated and flexible plate extending longitudinally with respect to said each extrusion, and a plurality of longitudinal and shallow grooves on said plate to enhance the flexibility thereof in order to allow one pair of sash guiding and supporting members to move substantially independently with respect to the other pair of said sash guiding and supporting members.

* * * * *